US006243550B1

(12) United States Patent
Fuchiwaki et al.

(10) Patent No.: US 6,243,550 B1
(45) Date of Patent: Jun. 5, 2001

(54) COMPACT IMAGE FORMATION SYSTEM HAVING A PLURALITY OF PAPER TRAYS

(75) Inventors: Takashi Fuchiwaki; Yasutomo Ishii; Nobukazu Takahashi; Kazunori Numao; Fumio Furusawa; Junichiro Sameshima; Hitoshi Funato; Ryuji Hattori, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/561,923

(22) Filed: May 1, 2000

Related U.S. Application Data

(63) Continuation of application No. 09/200,454, filed on Nov. 27, 1998, now Pat. No. 6,078,762.

(30) Foreign Application Priority Data

Dec. 1, 1997 (JP) ..... 9-330529
Nov. 17, 1998 (JP) ..... 10-327233

(51) Int. Cl.[7] ..... G03G 15/00
(52) U.S. Cl. ..... 399/94; 399/92
(58) Field of Search ..... 399/94, 92, 97, 399/320, 302, 308; 347/102

(56) References Cited

U.S. PATENT DOCUMENTS 5,221,951 * 6/1993 Sakamoto ..... 399/402 X
5,666,599 * 9/1997 Miyasaka et al. ..... 399/223 X
5,822,655 * 10/1998 Ikeda ..... 399/302 X
5,835,831 * 11/1998 Staudenmayer et al. ..... 399/308
5,838,456 * 11/1998 Wagi et al. ..... 399/302 X
5,887,218 * 3/1999 Yuu et al. ..... 399/302

FOREIGN PATENT DOCUMENTS 3-192284 * 8/1991 (JP) .
4-36777 * 2/1992 (JP) .
4-195173 * 7/1992 (JP) .
5-338832 12/1993 (JP) .
6-138744 5/1994 (JP) .
7-77855 3/1995 (JP) .
7-199678 8/1995 (JP) .
11-24427 * 1/1999 (JP) .

* cited by examiner

*Primary Examiner*—Quana M. Grainger
(74) *Attorney, Agent, or Firm*—Oliff & Berridge, PLC

(57) ABSTRACT

An image formation apparatus for document production of reproduction which includes a plurality of paper feed trays T1–T4 placed in overlapped relation at multiple stages from top to bottom wherein the length of the top-stage paper feed tray T1 in the paper feed direction is formed shorter than the length of each of the paper feed trays T2–T4 at lower stages in the paper feed direction, an image support 16, an intermediate transfer body B, and a secondary transfer device 31 placed in a tray upward paper feed side space Sa above the paper feed tray T1, a fuser T placed in a top-stage tray side space Sb1 on the side of the top-stage paper feed tray T1 and an upward side space Sb2 above the space Sb1, and a developing unit D placed in the upward side space Sb2.

8 Claims, 5 Drawing Sheets

COMPACT IMAGE FORMATION SYSTEM HAVING A PLURALITY OF PAPER TRAYS

This is a Continuation of application Ser. No. 09/200,454 filed Nov. 27, 1998 now U.S. Pat. No. 6,078,762. The entire disclosure of the prior application is hereby incorporated by reference herein in its entirety.

BACKGROUND OF THE INVENTION

This invention relates to an image formation system such as an electrophotographic color copier or a color laser-beam printer and in particular to an image formation system making the effective use of the space therein.

To place parts required for the image formation operation, such as a fuser and units for feeding and transporting recording sheets in a paper feed tray, in an image formation system, it is necessary to make it possible to miniaturize the image formation system making the effective use of space and facilitate maintenance of the image formation system.

To miniaturize the image formation system, the parts such as the fuser and the paper feed and transport units need to be placed with good space efficiency within the limited volume range of the image formation system.

The following related art (J01) is known as an art for placing the parts so as not to waste space in an image formation system:

(J01) (art described in the Unexamined Japanese Patent Application Publication No. Hei 5-338832)

FIG. 5 is a schematic representation of the art described in the Unexamined Japanese Patent Application Publication No. Hei 5-338832.

The apparatus illustrated in FIG. 5 includes paper feed trays 02*a* and 02*b* below image support 01. The paper feed tray 02*a* is located above paper feed tray 02*b* and has a length which is approximately one-half the length of paper feed tray 02*b*.

The non-paper feed end parts (left end parts in the figure) opposite to the paper feed side end parts (right end parts in the figure) of the smaller paper feed tray 02*a* and the normal paper feed trays 02*b* are placed so as to overlap each other up and down. Therefore, a space Sg is formed on the paper feed side of the small paper feed tray 02*a*.

Sheet passages 03*a* and 03*b* are connected to the paper feed side end parts of the small paper feed tray 02*a* and the normal paper feed tray 02*b* respectively, and the sheet passage 03*b* to the normal paper feed tray 02*b* connects to a merging passage 04.

The sheet passage 03*a* to the paper feed tray 02*a* at the top stage is bent and connects to the merging passage 04 and a sheet transport passage 07 at a merging point 06 in the space Sg.

A recording sheet (not shown) sent out from the small paper feed tray 02*a* at the top stage in the arrow direction shown in FIG. 5 is transported on the sheet passage 03*a* through the merging point 06 to the sheet transport passage 07.

the merging point 06 is placed in the space Sg on the paper feed side of the small paper feed tray 02*a,* whereby if paper feed trays are placed at multiple stages as much as possible within the limited volume range of the image formation system, the curvature radius of the bent part of the sheet passage 03*a* to the paper feed tray 02*a* connecting to the merging part 06 can be enlarged and when a card with large friction, a firm film, etc., passes through along the sheet passage 03*a,* a jam, etc., is prevented from occurring.

The following related art (J02) is known as an art devising placement of the parts of an image formation system for miniaturizing the image formation system and facilitating maintenance thereof:

(J02) (art described in the Unexamined Japanese Patent Application Publication No. Hei 6-138744)

In this art described here, a plurality of color developing units are placed vertically in overlapped relation below an intermediate transfer belt placed in an image formation system and a belt-like image support opposed to the developing units and vertically extending is placed. The effective use of space in the image formation system is made because of the placement, etc., for making the image formation system compact and facilitating maintenance thereof.

The following related art (J03) is known as an art for placing the parts of an image formation system laying emphasis on easy maintenance of the parts in the image formation system:

(J03) (art described in the Unexamined Japanese Patent Application Publication No. Hei 7-199678)

In this art described here, an intermediate transfer body unit for holding an intermediate transfer body is placed detachably in an image formation system. An intermediate transfer body cleaning device for collecting residue toner on the intermediate transfer body is placed detachably in the intermediate transfer body unit. At the maintenance time, if the intermediate transfer body unit is drawn out from the image formation system, the intermediate transfer body cleaning device is also drawn out together, saving trouble to adjust the contact position between the intermediate transfer body cleaning device and the intermediate transfer body after the termination of the maintenance.

SUMMARY OF THE INVENTION

It is therefore a first object of the invention to provide a compact image formation system adapted to form an image on paper through an intermediate transfer body and fix the formed image and in particular to a compact image formation system having a developing unit for developing a toner image and a fuser for fixing a toner image transferred to paper.

It is a second object of the invention to provide a compact image formation system having components placed therein with good weight balance thereof, thereby lessening image degradation caused by banding etc.

(Problems involved in (J01) to (J03))

The object of the related art (J01) is as follows: If paper feed trays are placed as many as possible in the image formation system, when a card with large friction, a firm film, etc., is sent out and transported to the sheet passage 03*a,* a jam, paper feed failure, etc., is prevented from occurring. Thus, the weight balance of the image formation system is not considered for placing the parts in the image formation system. Therefore, if the weight balance of the image formation system is bad, stability of the image formation system is degraded and banding easily occurs.

In the related arts (J02) and (J03) like the related art (J01), the weight balance of the image formation system is not considered for placing the parts in the image formation system. Therefore, stability of the image formation system is degraded and banding easily occurs. The stability at the move or transport time of the image formation system worsens, causing a problem to arise in safety.

The inventors have examined a placement method of parts considering the weight balance of an image formation system for stabilizing the image formation system so as not to waste space in the image formation system.

To place paper feed trays at multiple stages in an image formation system, the length of the paper feed tray for storing small-sized recording sheets in the paper feed direction is fairly shorter than the length of the paper feed tray for storing recording sheets of the maximum size in the paper feed direction (normally, about a half). Therefore, if the paper feed tray for storing small-sized recording sheets is placed at the top stage and to one side of the image formation system, a parts placement space can be formed on the side of the paper feed tray at the top stage. If the parts such as an image support, a transport device, and an intermediate transfer body are placed in a space above the paper feed tray at the top stage placed to one side of the image formation system and a developing unit and a fuser are placed on the opposite side, the weight balance of the image formation system is achieved.

It is therefore an object of the invention to place parts so as to make the effective use of space in an image formation system and keep the weight balance of the image formation system (O01).

It is another object of the invention to place parts so as to make the effective use of space in an image formation system and enable miniaturization of the image formation system (O02).

(The invention)

To solve the problems, the image system of the invention comprises the following requirements:

(Aspect 1)

An image formation system comprising:

an image support having a rotating surface for supporting a toner image thereon;

a developing unit being disposed adjacent to the image support for forming a toner image on the surface of the image support;

an intermediate transfer body being disposed adjacent to the image support, to which the toner image formed by the developing unit is transferred;

a primary transfer device for transferring the toner image from the image support to the intermediate transfer body;

a second transfer device for transferring the toner image transferred from the image support to the intermediate transfer body to a recording sheet;

a thermal fuser being disposed below the developing unit and on a side of the secondary transfer device for thermally fixing the toner image transferred to the recording sheet by the secondary transfer device on the recording sheet; and heat insulation means being disposed between the thermal fuser and the developing unit for preventing heat generated from the thermal fuser from being transmitted to the developing unit.

(Aspect 2)

An image formation system comprising:

an image support having a rotating surface for supporting a visible image thereon;

a developing unit being disposed adjacent to the image support for forming a visible image on the surface of the image support;

an intermediate transfer body being disposed adjacent to the image support, to which the visible image formed by the developing unit is transferred;

a primary transfer device for transferring the visible image from the image support to the intermediate transfer body;

a secondary transfer device for transferring the visible image transferred from the image support to the intermediate transfer body to a recording sheet;

a fuser being disposed below the developing unit and on a side of the secondary transfer device for fixing the visible image transferred to the recording sheet by the secondary transfer device on the recording sheet;

a sheet tray being disposed below the secondary transfer device and the fuser for storing recording sheets on which images are formed; and a top stage sheet tray being shorter than the sheet tray with respect to a paper feed direction and disposed at a position below the secondary transfer device and not overlapping the thermal fuser with respect to an up and down direction.

In the invention, the expression "paper tray length at each stage in the paper feed direction" is used to mean the length from the outer side of the paper feed tray opposed to one outer side wall of the image formation system main body to the outer side of the paper feed tray opposed to the opposite side wall of the image formation system main body if a number of paper feed trays are placed at one stage.

DETAILED DESCRIPTION OF THE PREFERRED EMBODIMENTS

Figure 1:
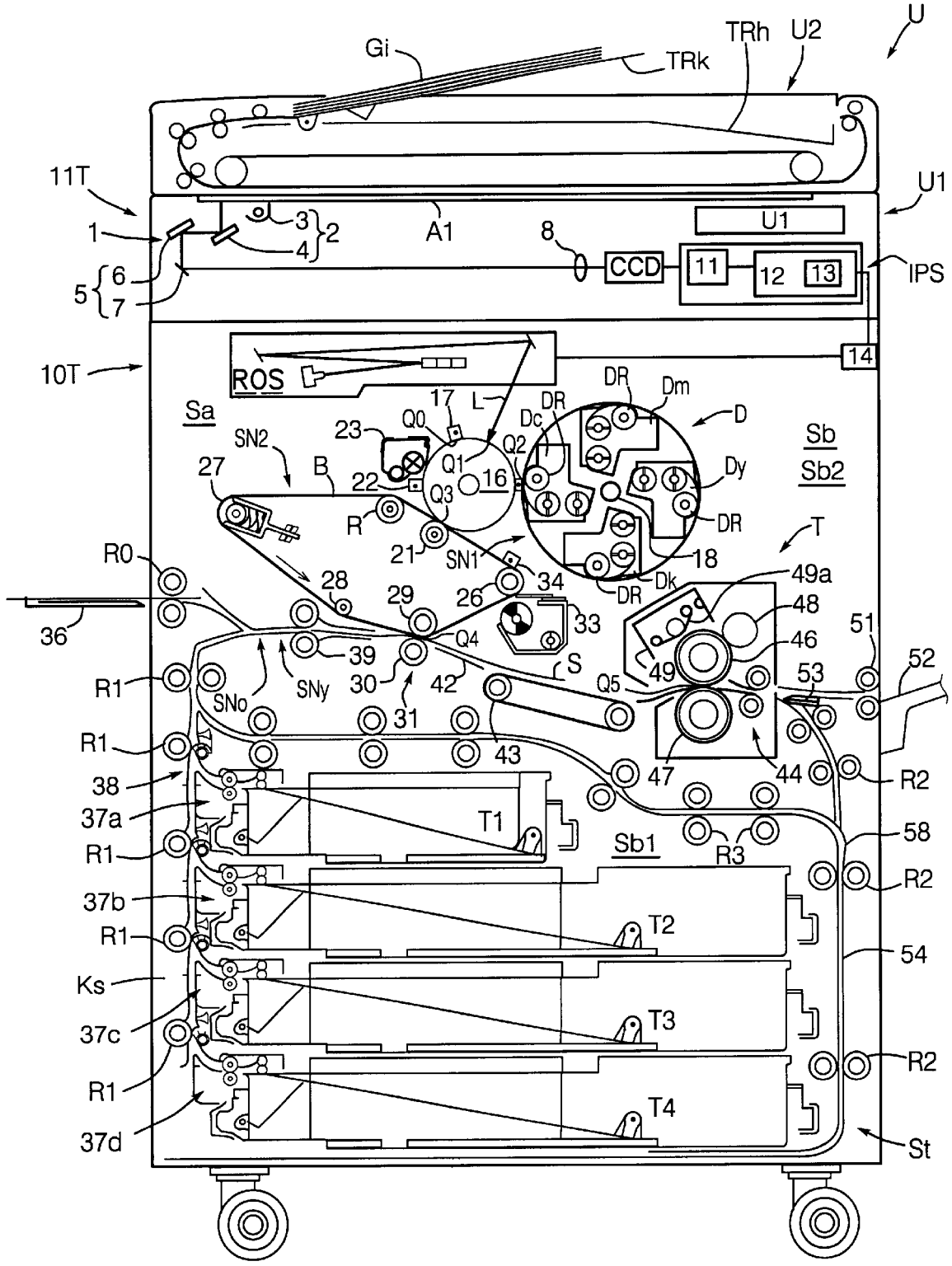
FIG. 1 is a general schematic representation of an image formation system of a first embodiment of the invention.

Referring now to the accompanying drawings, there are shown preferred embodiments of the invention, but the invention is not limited to the embodiments described below.

For easy understanding of the description to follow, in the drawings, the back and forth direction is the X axis direction, the side to side direction is the Y axis direction, the up and down direction is the Z axis direction, and the directions or sides indicated by arrows X, −X, Y, −Y, Z, and −Z are front, rear, right, left, up (top, and down (bottom).

In the drawings, the symbol with • entered in ○ means an directed from the rear of the pane of each drawing to the front and the system with X enter in ○ means an arrow directed from the front of the plane of each drawing to the rear.

First Embodiment

FIG. 1 is a general schematic representation of an image formation system of a first embodiment of the invention.

In the figure, an image formation system U comprises a digital copier U1 as an image formation system main body having a platen glass (transparent original bed) A1 on the top and an automatic original transporter U2 attached detachably onto the platen glass A1.

The automatic original transporter U2 has an original paper feed tray TRk on which originals Gi (i=1, 2, . . . ) of various sizes to be copied are placed in overlapped relation. The original Gi placed on the original paper feed tray TRk is transported to a copy position on the platen glass A1 and the copied original Gi is discharged to an original paper discharge tray TRh.

The copier U1 comprises a UI (user interface) an IIT (image input terminal) as an image read section and an IOT (image output terminal) as an image recording operation section placed in order below the platen glass A1, and an IPS (image processing system) disposed between the IIT and the IOT.

The UI is a section for the user to enter an operation command signal such as copy start and has a display section, a copy start button, a setup-number-of-copies input key, a color mode setting key, etc. The display section displays information concerning the current setup state of the image formation system U.

The IIT, an original reader, placed below the transparent platen glass A1 on the top of the copier main body U1 has an exposure system registration sensor (plate registration sensor) Sp placed at a platen registration position (OPT position) and an exposure optical system 1 which has a movable lamp unit 2 comprising an original lighting lamp 3 and a first mirror 4 in one piece and a moving mirror unit 5 moving at half speed of the move speed of the lamp unit 2. This moving mirror unit 5 consists of a second mirror 6 and a third mirror 7.

The lamp unit 2 moves in the side to side direction (Y axis direction) in FIG. 1 in parallel with the original Gi and the moving mirror unit 5 moves a half distance of the move distance of the lamp unit 2 at half speed of the move speed of the lamp unit 2. At the time, the distance between the original Gi and a lens 8 is kept constant and meanwhile the reflected light on the original Gi lighted by the lamp 3 passes through the exposure optical system 1 and is converged on a CCD (solid state image sensing device) having a function of converting original reflected light converged on the image pickup face into an electric signal.

The IPS has image read data output means 11 for adjusting the gain of the analog electric signal of the read image provided by the CCD of the IIT, converting the analog signal into a digital signal, performing shading correction, etc., and outputting image read data. The IPS also has write image data output means 12 to which the image read data output by the image read data output means 11 is input. The write image data output means 12 has image memory 13 for temporarily storing image data. It also has a function of performing data processing of density correction, scaling correction, etc., for the input read image data and outputting the resultant data to the IOT as write image data (laser drive data).

The write image data (laser drive data) output by the write image data output means 12 of the IPS is input to a laser drive signal output unit 14 of the IOT, which (14) then outputs a laser drive signal responsive to the input image data to an ROS (latent image formation unit).

The ROS scans a laser beam modulated by the input laser drive signal over a latent image write position Q1 on the surface of a rotating image support 16. The rotation speed of the image support 16 is measured by an image support speed sensor SN1 placed at the end of the image support 16 in the width direction thereof.

A charger 17 is placed in a charge area Q0 upstream from the latent image write position Q1 along the rotation direction of the image support 16 in the surrounding thereof, and a rotary developing unit D is placed in a developing area Q2 set downstream from the latent image write position Q1 and at the right (Y side) of the image support 16. The developing unit D has four color (K, Y, M and C) developing devices Dk, Dy, Dm, and Dc mounted surrounding a developing device support rotation shaft 18. Each of the developing devices Dk, Dy, Dm, and Dc has a developing roll DR. The developing rolls Dr of the four color developing devices Dk, Dy, Dm, and Dc move to the developing area Q2 in order with rotation of the developing device support rotation shaft 18. The developing devices Dk, Dy, Dm, and Dc are devices for developing an electrostatic latent image on the image support 16 to K (black), Y (yellow), M (magenta), and C (cyan) color toner images respectively.

A rotating intermediate transfer belt (intermediate transfer body) B and a primary transfer roll (primary transfer device) 21 on the inner peripheral surface of the intermediate transfer belt B are placed in a primary transfer area Q3 set downstream from the developing area Q2 and on the bottom (−Z) side of the rotating image support 16 along the surface thereof.

The rotation speed of the intermediate transfer belt B is measured by an intermediate transfer body speed sensor SN2 placed at the end of the intermediate transfer belt B in the width direction thereof.

An intermediate transfer body press roll R is placed downstream from the primary transfer roll 21 placed on the inner peripheral surface of the intermediate transfer belt B in the rotation direction of the rotating image support 16. While the intermediate transfer belt B and the image support 16 rotate at the same speed, the primary transfer roll 21 and the intermediate transfer body press roll R move away from or press the rear face of the intermediate transfer belt B for causing the intermediate transfer belt B to move away from or come in contact with the image support 16.

An electricity remover 22 and a cleaner unit 23 are placed downstream from the primary transfer area Q3 along the rotation image support 16.

The intermediate transfer belt B is placed on four rolls of a drive roll 26, a tension roll 27, an idler roll 28, and an inner secondary transfer roll 29, and turns in the arrow direction through the drive roll 26 almost at the same speed as the image support 16.

An outer secondary transfer roll 30 is placed on the side opposed to the inner secondary transfer roll 29 with respect to the intermediate transfer belt B in a secondary transfer area Q4 in the surrounding of the intermediate transfer belt B. The inner secondary transfer roll 29 and the outer secondary transfer roll 30 make up a secondary transfer roll (secondary transfer device) 31 of the first embodiment.

The inner secondary transfer roll 29 and the outer secondary transfer roll 30 are connected to a secondary transfer power supply circuit (not shown) and a bias is applied to the outer secondary transfer roll 30 by the secondary transfer power supply circuit for transferring a toner image on the intermediate transfer belt B to a recording sheet S.

A belt cleaning device (intermediate transfer body cleaning device) 33 for removing untransferred toner remaining on the surface of the intermediate transfer belt B is placed downstream from the outer secondary transfer roll 30 in the transport direction of the intermediate transfer belt B. The outer secondary transfer roll 30 and the belt cleaning device 33 can be pressed against and moved away from the intermediate transfer belt B. An electricity remover 34 is placed downstream from the belt cleaning device 33 for removing charges remaining on the surface of the intermediate transfer belt B after secondary transfer.

A sheet storage section Ks is provided below the intermediate transfer belt B. A first paper feed tray T1, a second paper feed tray T2, a third paper feed tray T3, and a fourth paper feed tray T4 for storing sheets are housed detachably in the sheet storage section Ks in order from top to bottom. A manual tray 36 is disposed at an upper left position of the first paper feed tray T1. Recording sheets S stored in the paper feed trays T1 to T4 and the manual tray 36 are fed by paper feed members 37*a* to 37*d* and a manual paper feed roll R0 and are transported through a first sheet transport passage 38 with a plurality of transport rolls R1 placed to the secondary transfer area Q4. The length of the first paper feed tray T1, the top paper feed tray, in the paper feed direction thereof is formed shorter than that of each of the lower paper feed trays T2 to T4 in the paper feed direction thereof (for example, about a half). Therefore, a space is formed on the right (Y side) of the first paper feed tray T1.

If the recording sheet S transported along the first sheet guide 38 is an OHP sheet, it is sensed by an OHP sensor SNo. The recording sheet S passing through the OHP sensor SNo is detected by a sheet registration sensor SNy. A registration roll 39 for once stopping the transported recording sheet S and then transporting the recording sheet S into the secondary transfer area Q4 at a predetermined timing is placed upstream from the secondary transfer area Q4 in the sheet transport direction thereof at the termination of the first sheet guide 38.

Secondary transfer of an unfixed toner image on the intermediate transfer belt B is executed to the recording sheet S transported into the secondary transfer area Q4 by the outer secondary transfer roll 30 and the inner secondary transfer roll 29.

For single-color image formation, the secondary transfer of an unfixed toner is executed immediately after primary transfer to the intermediate transfer belt B; for full-color image formation, the intermediate transfer belt B makes four turns, whereby K (black), Y (yellow), M (magenta), and C (cyan) color toner images are primarily transferred to the intermediate transfer belt B in overlapped relation, then secondarily transferred at a time in the secondary transfer area Q4.

The outer secondary transfer roll 30 and the belt cleaning device 33 are disposed so that they can move away from or come in contact with the intermediate transfer belt B; to form a color image, the members are away from the intermediate transfer belt B until the unfixed toner image of the last color is primarily transferred to the intermediate transfer belt B.

The recording sheet S to which the unfixed toner image is transferred moves along the top face of a sheet guide 42 and is transported on a transfer belt 3 to a fixing position Q5. When the recording sheet S passes through the fixing position Q5, the unfixed toner image on the recording sheet S is heated and fixed by a fuser T.

The fuser T is placed below the developing unit D (−Z direction) and at the right of the intermediate transfer belt B and the belt cleaning device 33 is placed between the fuser T and the intermediate transfer belt B. Thus, heat of the fuser T is blocked by the belt cleaning device 33 and is hard to transmit to the intermediate transfer belt B.

The fuser T has a fixing roll 44 placed on the transport path of the recording sheet S. The fixing roll 44 consists of a heating roll 46 and a pressurizing roll 47. Placed on the surface of the heating roll 46 are a mold release agent application roll (mold release agent supply device) 48 for applying a mold release agent and a mold release agent removal device 49 for scraping off the applied and extra mold release agent with a contained nonwoven cloth 49*a*. The mold release agent removal device 49 can move away from and come in contact with the surface of the heating roll 46.

The recording sheet S with the unfixed toner image heated and fixed by the fuser T is discharged through a paper discharge roller 51 to a paper discharge tray 52.

The space above the sheet storage section Ks of the copier U1 is formed of a tray upward paper feed side space Sa above the first paper feed tray T1 at the top stage and a tray upward non-paper feed side space Sb on the right of the space Sa (Y direction). The image support 16, the intermediate transfer belt B, and the secondary transfer roll 31 are placed in the tray upward paper feed side space Sa in order from top to bottom. The tray upward non-paper feed side space Sb is formed of a top-stage tray side space Sb1 formed on the right of the first paper feed tray T1 (Y direction) and an upward side space Sb2 above the space Sb1. The fuser T is placed in the lower part of the tray upward non-paper feed side space Sb (the lower part of the upward side space Sb2 and the top-stage tray side space Sb1) and the developing unit D is placed in the upper part of the tray upward non-paper feed side space Sb (the upper part of the upward side space Sb2).

A diversion gate 53 is placed downstream from the fuser T and is used to divert the transport direction of the recording sheet S with the unfixed toner image fixed to a sheet inversion passage 54 or the discharge tray 52. A plurality of sheet transport rolls R2 are placed along the sheet inversion passage 54. The sheet inversion passage 54 is connected to a sheet circulation passage 56 and a plurality of sheet transport rolls R3 are placed on the sheet circulation passage 56.

A sheet-like and comb-teeth-like mylar gate 58 disposed at the connection part of the sheet inversion passage 54 and the sheet circulation passage 56 becomes elastically deformed to allow the recording sheet S to move downward when the passed recording sheet S is transported downward; when the recording sheet S passing through the mylar gate 58 is switched back and transported upward, the mylar gate 58 guides the recording sheet S in the direction of the sheet circulation passage 56.

The members 38, 39, Sny, R0 to R3, and 53 to 58 make up a sheet transporter St.

(Operation of First embodiment)

In FIG. 1, the image support 16 rotates in the arrow direction and the charger 17 charges the surface of the image support 16 uniformly. An electrostatic latent image of the first color (for example, K (black)) is formed on the charged image support 16 by the ROS (latent image formation unit).

The electrostatic latent image is developed in toner by the developing unit D to form a visible toner image. The toner image is transported to the primary transfer area Q3 where the primary transfer roll 21 is placed with rotation of the image support 16.

In the primary transfer area Q3, a voltage of the opposite polarity to the toner is applied to the primary transfer roll 21 pressed against the image support 16 from the rear of the intermediate transfer belt B.

By the action of an electric field of the opposite polarity to the toner image, the toner image is electrostatically attracted onto the intermediate transfer belt B and is primarily transferred.

Likewise, toner images of the second color (for example, yellow Y), the third color (for example, magenta M), and the fourth color (for example, cyan C) are formed in order and are overlapped on the intermediate transfer belt B, whereby a multiple toner image is formed.

The multiple toner image transferred to the intermediate transfer belt B is transported to the secondary transfer area Q4 with rotation of the intermediate transfer belt B. The recording sheet S is transported to the secondary transfer area Q4 matching the timing at which the multiple toner image is transported to the secondary transfer area Q4.

In the secondary transfer area Q4, the multiple toner image on the intermediate transfer belt B is secondarily transferred onto the recording sheet S by a secondary transfer voltage applied between the outer secondary transfer roll 30 installed on the surface of the intermediate transfer belt B where the toner image is supported and the inner secondary transfer roll 29 placed on the rear of the intermediate transfer belt B.

The recording sheet S with the multiple toner image transferred is transported to the fuser T, which then fixes the toner image to a permanent image by pressurizing/heating treatment. The residue toner on the intermediate transfer belt B where transfer of the multiple toner image to the recording sheet S is complete is removed by the belt cleaning device 33 disposed downstream from the secondary transfer area Q4 for the next transfer.

To transfer a single-color image, a toner image primarily transferred is immediately secondarily transferred and is transported to the fuser T. To transfer a multi-color image with colors overlapped, the intermediate transfer belt B and the image support 16 are synchronized in rotation so that color toner images match accurately in the primary transfer area Q3. The recording sheet S with unfixed toner image fixed is discharged to the discharge tray 52 by the paper discharge roll 51.

To make a double-sided copy, the diversion gate 53 disposed downstream from the fuser T is switched for once feeding the recording sheet S with an image already transferred to one side into the downward sheet inversion passage 54 for switching back the recording sheet S, and the recording sheet S is guided by the mylar gate 58 in the direction of the sheet circulation passage 56 for again transporting to the secondary transfer area Q4.

The space in the image formation system U is divided into the left and right sides and the fuser T and the developing unit D are placed in the tray upward non-paper feed side space Sb (right). The image support 16, the intermediate transfer body B, the secondary transfer device 31, and the top-stage paper feed tray (first tray) T1 are placed on the left of the tray upward non-paper feed side space Sb in the image formation system U. According to the placement, the parts of the image formation system are placed systematically and work of maintenance, inspection, etc., is facilitated. The weight balance of the image formation system becomes good, the stability of the system is improved, and banding can be prevented from occurring.

The image formation system U of the first embodiment can be miniaturized by forming the top-stage paper feed tray T1 in a size with no fruitless volume, producing newly the top-stage tray side space Sb1 on the side of the top-stage paper feed tray T1, and placing a part of the fuser T in the top-stage tray side space Sb1.

Further, in the first embodiment, the upper end position of an intermediate transfer belt B, a primary transfer area Q3, a secondary transfer area Q4, and a fixing area Q5 are placed so as to become lower in order.

Thus, a secondary transfer device 31 can be placed below the intermediate transfer belt B and a fuser T can be placed below and on the side of the secondary transfer device 31. Therefore, an image support 16, the intermediate transfer belt B, and the secondary transfer device 31 can be placed in a tray upward paper feed side space Sa above a first paper feed tray T1 at the top stage and the fuser T and a developing unit D can be placed in a tray upward non-paper feed side space Sb containing a top-stage tray side space Sb1 on the side of the first paper feed tray T1 and an upward side space Sb2 above the top-stage tray side space Sb1.

Second Embodiment

Figure 2:
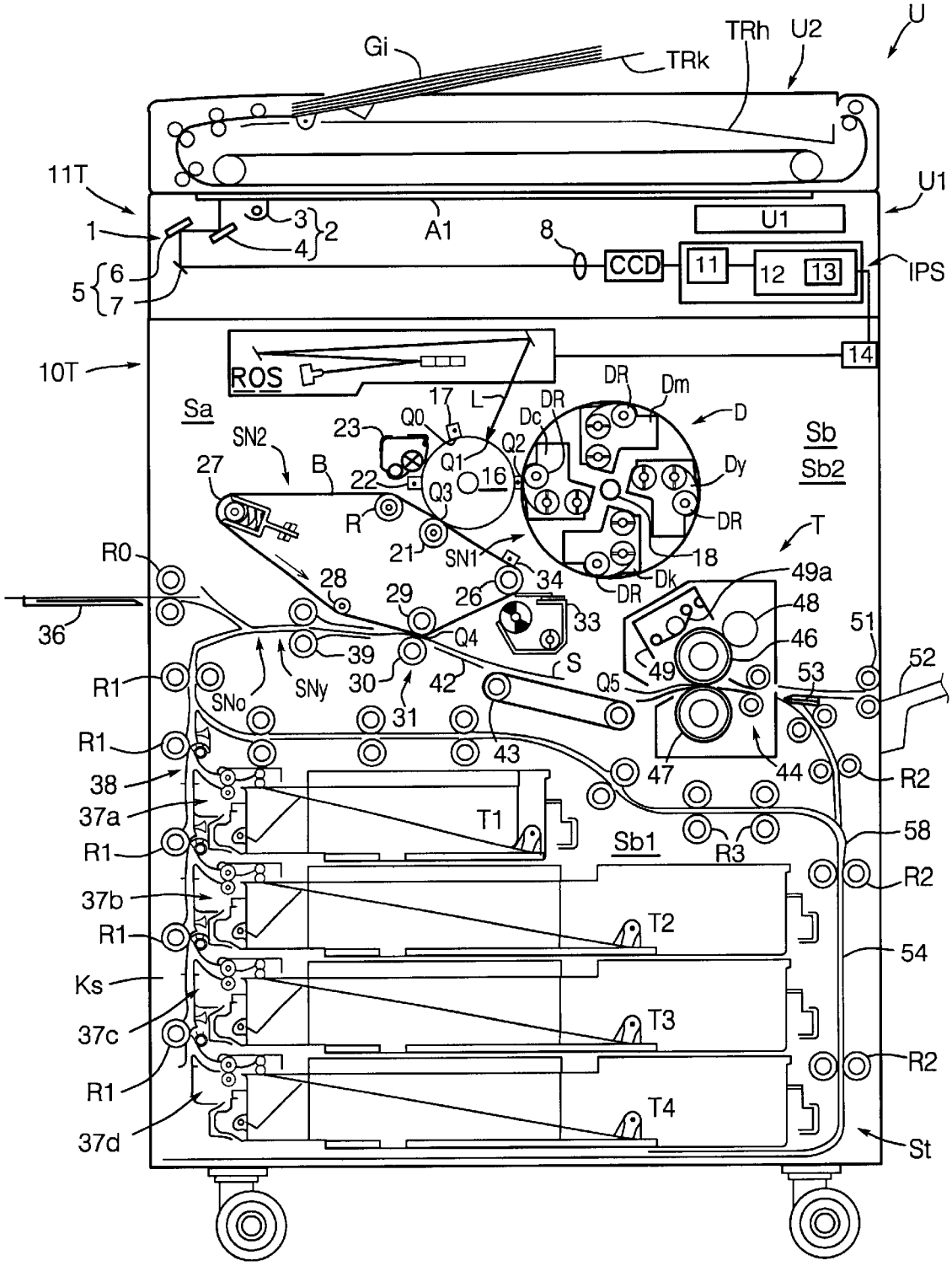
FIG. 2 is a general schematic representation of an image formation system of a second embodiment of the invention.

FIG. 2 is a general schematic representation of an image formation system of a second embodiment of the invention.

Parts identical with or similar to those previously described with reference to FIG. 1 are denoted by the same reference numerals in FIG. 2 and will not be discussed again in detail.

The second embodiment is the same as the first embodiment except that:

The length of a first paper feed tray T1 in the paper feed direction thereof is formed shorter than that in the first embodiment. The length of a second paper feed tray T2 in the paper feed direction thereof is formed shorter than that of a third paper feed tray T4, a fourth paper feed tray T4 at the lower stage. Therefore, a space is also formed on the right of the second paper feed tray T2 (Y direction) and a top-stage tray side space Sb1 on the right of the first paper feed tray T1 (Y direction) is enlarged as compared with that in the first embodiment.

With the image formation system of the second embodiment of the invention like that of the first embodiment, the parts of the image formation system are placed systematically, so that work of maintenance, inspection, etc., is facilitated, and the weight balance of the image formation system also becomes good, thus banding can be prevented from occurring.

Further, the parts, etc., of the image formation system are stored in the space formed on the right of the second paper feed tray T2 (Y direction).

Figure 3:
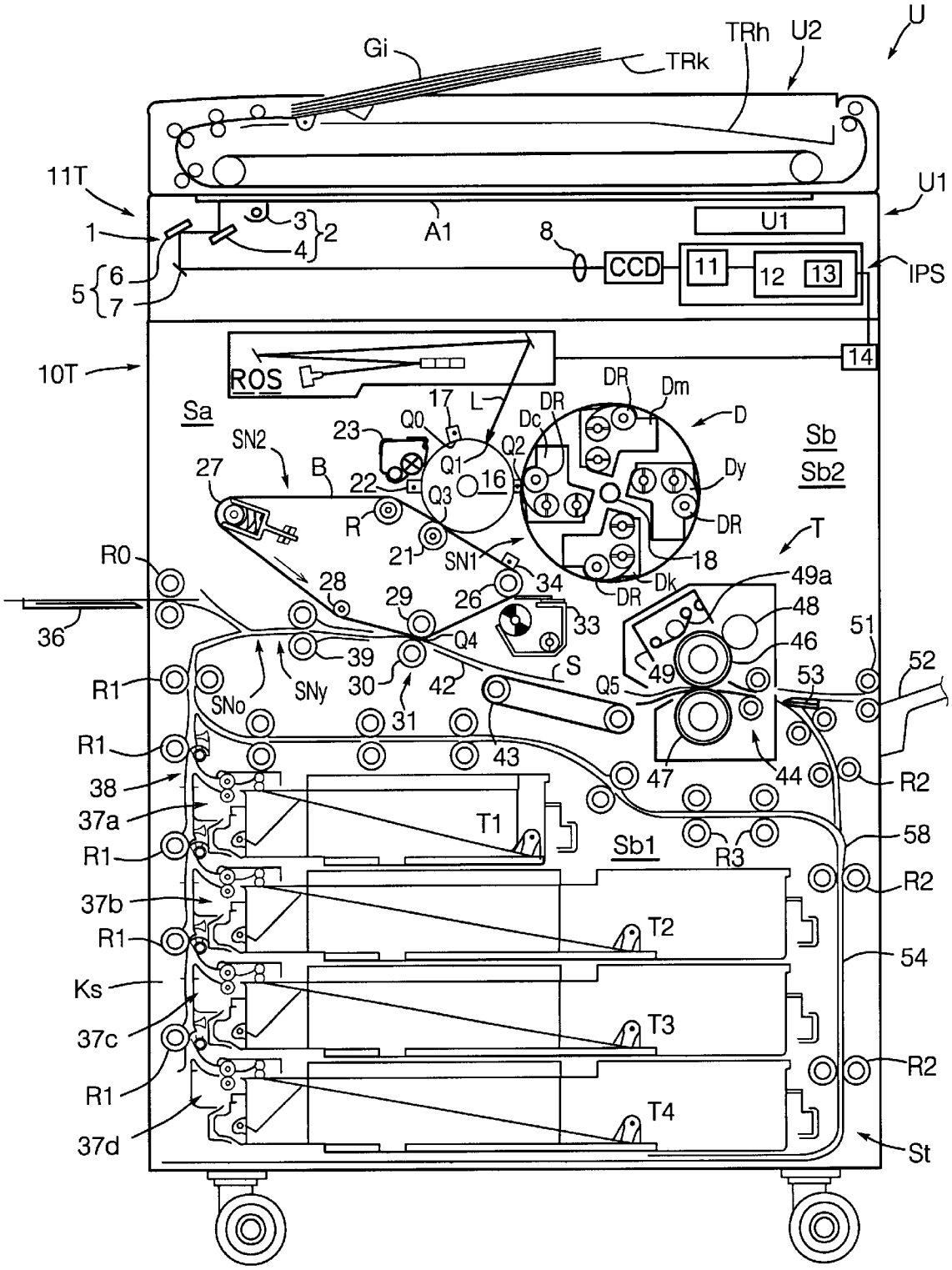
FIG. 3 is a general schematic representation of an image formation system of a sixth embodiment of the invention.
Figure 4:
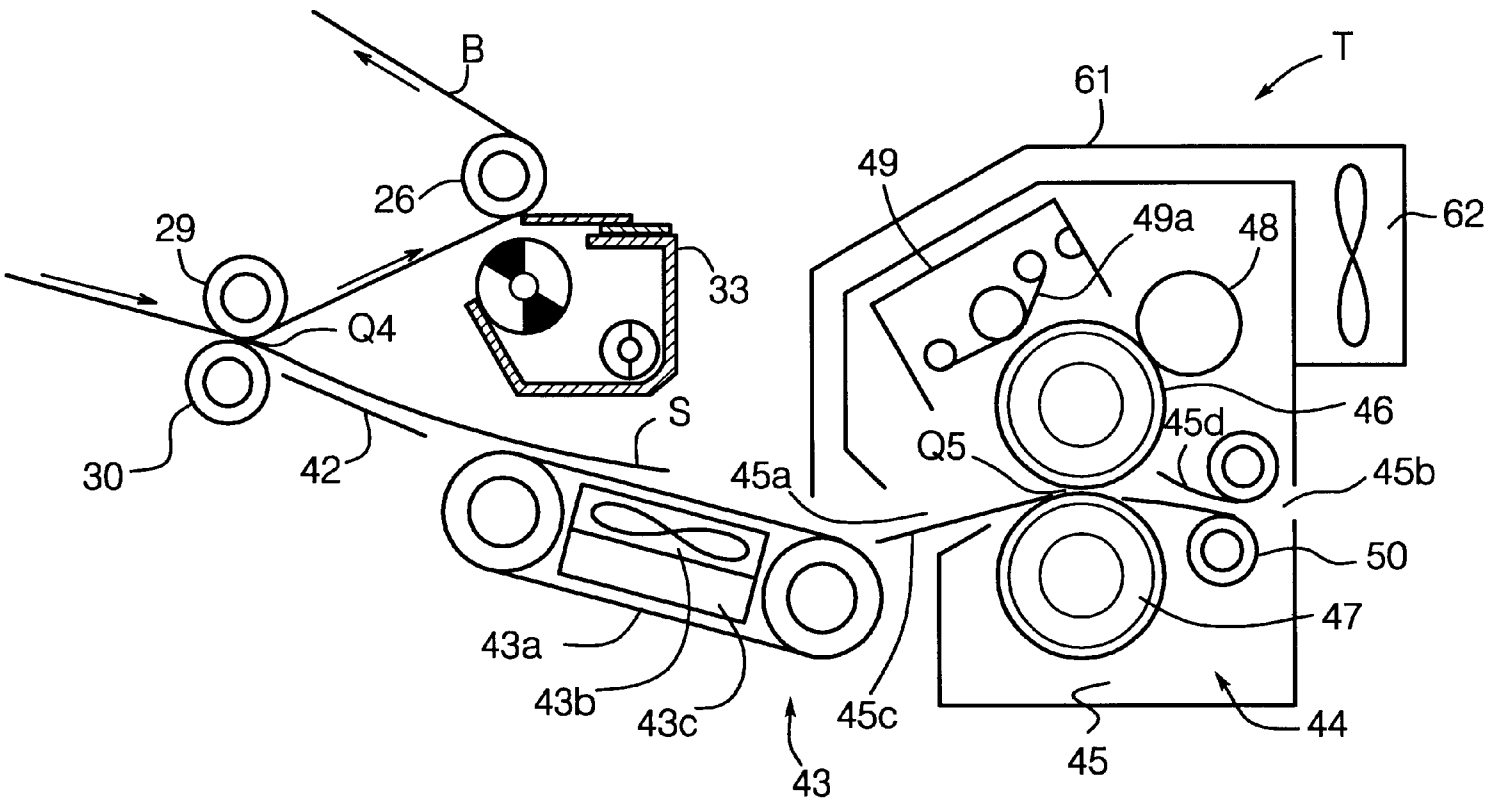
FIG. 4 is an enlarged schematic representation of the main part of the image formation system shown in FIG. 3.
Figure 5:
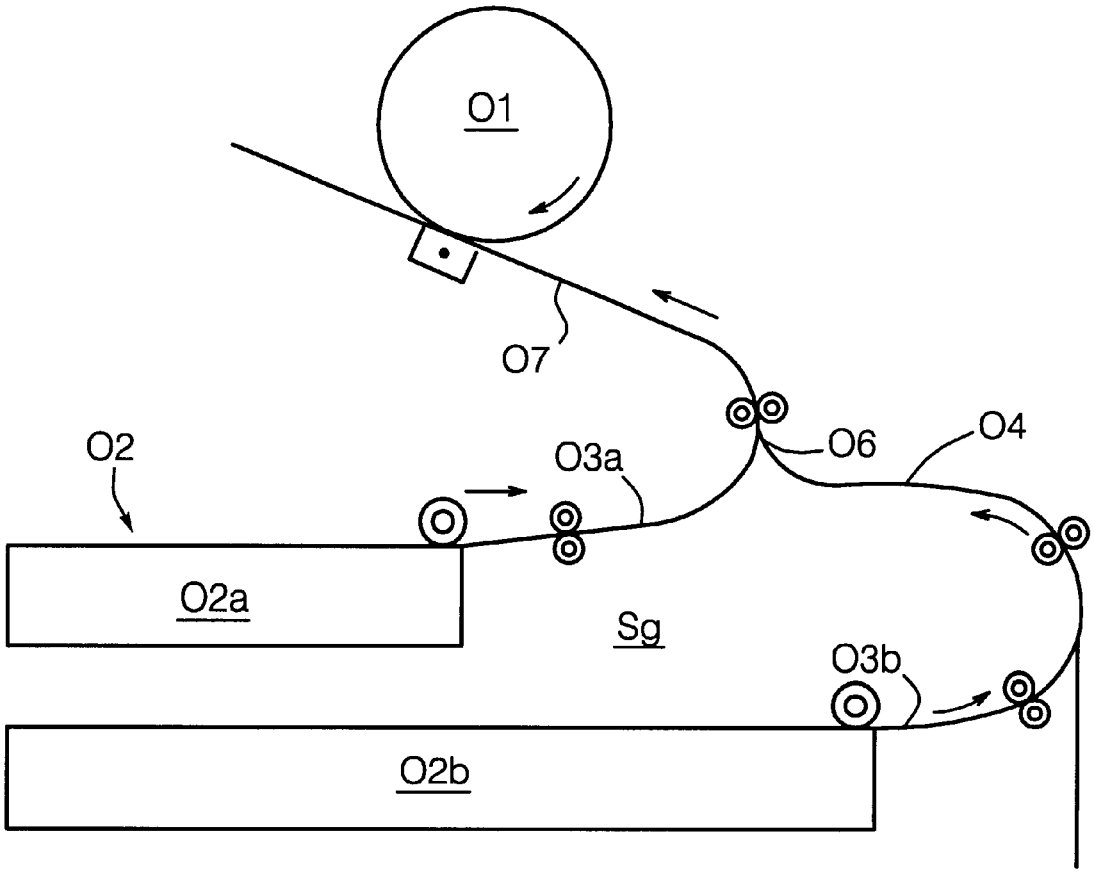
PRIOR ART Fig. 5
FIG. 5 is a schematic representation of an art described in the Unexamined Japanese Patent Application Publication No. Hei 5-338832.

FIG. 3 is a general schematic representation of an image formation system of a second embodiment of the invention. FIG. 4 is an enlarged schematic representation of the main part of the image formation system shown in FIG. 3.

Parts identical with or similar to those previously described with reference to FIG. 1 are denoted by the same reference numerals in FIG. 3 and will not be discussed again in detail.

The second embodiment is the same as the first embodiment except that:

In FIG. 3 and FIG. 4, a vacuum transfer belt 43 is placed instead of the transfer belt 43 and a recording sheet S to which an unfixed toner image is transferred in a secondary transfer area Q4 is transported on the vacuum transfer belt 43 to the fuser T.

As shown in FIG. 4, the vacuum transfer belt 43 consists of a belt 43*a* supported on a belt support roll for rotation, a suction pump 43*b* for sucking air from the top face of the belt 43*a* to the rear, a duct 43*c* for exhausting air to the rear of a copier main body U1, and the like.

A fixing housing 45 of the fuser T is formed with an entry opening 45*a* for allowing a recording sheet S to enter a fixing area Q5 and a discharge opening 45*b* for discharging the recording sheet S passing through the fixing area Q5.

The fuser T has an entry side sheet guide 45*c* placed in the entry opening 45*a* and a discharge side sheet guide 45*d* and a fixing discharge roll 50 placed in the discharge opening 45*b*.

As seen in FIG. 4, the fixing housing 45 and the entry side sheet guide 45*c* of the fuser T exist, so that radiation heat from the surfaces of a pair of fixing rolls (fixing rotation members) 46 and 47 is applied from the entry opening 45*a*. In this case, the fixing housing 45 and the entry side sheet guide 45*c* serve as radiation heat prevention members (45 and 45*c*) for preventing direct application of radiation heat to the surface of an intermediate transfer belt B.

An air duct 61 is formed on the outside surface of the top of the fixing housing 45 of the fuser T and is connected to a suction pump 62. It has an outer wall member for shielding radiation heat from the outside surface of the top of the fixing housing 45 to a developing unit D.

The suction pump 62 sucks air in the surroundings of the entry opening 45*a* of the fuser T through the air duct 61 and discharges air to the rear of the copier main body U1. At this time, the air flowing through the air duct 61 cools the outside surface of the top of the fixing housing 45 and the outer wall member of the air duct 61. This can prevent radiation heat from the outside surface of the top of the fixing housing 45 or the outer wall member of the air duct 61 from heating the developing unit D above the fuser T to a high temperature; the adverse effect of heat causing locking to occur in toner in the developing unit D or the like is not produced. Thus, the image formation system of the sixth embodiment can be made compact in the width direction without adversely affecting the toner in the developing unit D.

Modified Embodiments

As many apparently widely different embodiments of the invention may be made without departing from the spirit and scope thereof, it is to be understood that the invention is not limited to the specific embodiments thereof except as defined in the appended claims. Modified embodiments of the invention are as follows:

(H01) a charge (corotron) can be adopted for the first transfer roll 21, the second transfer roll 21 transfer roll 31.

(H02) As the intermediate transfer body, an intermediate transfer drum can be used in place of the intermediate transfer belt.

(H03) Liquid developing can be used in place of dry toner developing.

(H04) As the thermal fuser, a roll and a belt, a pair of belts, a method of applying large pressure while heating, a heating and fixing method with no contact, etc., can be adopted in place of a pair of fixing rolls.

The described image formation system of the invention can provide the following advantages:

(E01) The parts can be placed so as to make the effective use of the space in the image formation system and the weight balance of the image formation system can be kept.

(E02) Since the parts can be placed so as to make the effective use of the space in the image formation system, the image formation system can be miniaturized.

What is claimed is:

1. An image formation system comprising:

an image support having a rotating surface for supporting a toner image thereon;

a developing unit being disposed adjacent to said image support for forming a toner image on the surface of said image support;

an intermediate transfer body being disposed adjacent to said image support, to which the toner image formed by said developing unit is transferred;

a primary transfer device for transferring the toner image from said image support to said intermediate transfer body;

a secondary transfer device for transferring the toner image transferred from said image support to said intermediate transfer body to a recording sheet;

a thermal fuser being disposed below said developing unit and on a side of said secondary transfer device for thermally fixing the toner image transferred to the recording sheet by said secondary transfer device on the recording sheet;

a heat insulator being disposed between said thermal fuser and said developing unit that prevents heat generated from said thermal fuser from being transmitted to said developing unit; and at least a second sheet tray positioned below a first sheet tray for storing recording sheets;

wherein the second sheet tray is longer than the first sheet tray and has a first portion that extends beyond the first sheet tray, and said thermal fuser is located above the first portion but vertically offset from the first sheet tray such that one of the vertical planes through the first sheet tray intersect said thermal fuser.

2. The image formation system of claim 1, wherein said heat insulator includes an air suction pump.

3. The image formation system of claim 1, wherein the upper end of said intermediate transfer body is located above a transfer position of said primary transfer device, said transfer position of said primary transfer device is located above the transfer position of said secondary transfer device, and the transfer position of said secondary transfer device is located above the position through which the recording sheet passes in said thermal fuser.

4. An image formation system according to claim 1, wherein said secondary transfer device is located above said first sheet tray.

5. An image formation system according to claim 1, further comprising a sheet inverter for inverting one of said recording sheets after it has passed through the thermal fuser; and a sheet transport apparatus which transports said one of said recording sheets after it has been inverted back to the secondary transfer device, said sheet transport apparatus having a portion which is (a) above said first portion and (b) within horizontal planes passing through the uppermost and lowermost points of said first sheet tray.

6. An image formation system comprising:

an image support having a rotating surface for supporting a visible image thereon;

a developing unit being disposed adjacent to said image support for forming a visible image on the surface of said image support;

an intermediate transfer body being disposed adjacent to said image support, to which the visible image formed by said developing unit is transferred;

a primary transfer device for transferring the visible image from said image support to said intermediate transfer body;

a secondary transfer device for transferring the visible image transferred from said image support to said intermediate transfer body to a recording sheet;

a fuser being disposed below said developing unit and on a side of said secondary transfer device for fixing the visible image transferred to the recording sheet by said secondary transfer device on the recording sheet;

a sheet tray being disposed below said secondary transfer device and said fuser for storing recording sheets on which images are formed; and at least a second sheet tray positioned below a first sheet tray for storing recording sheets;

wherein the second sheet tray is larger than the first sheet tray and has a first portion that extends beyond the first sheet tray, and said fuser is located above the first portion but vertically offset from the first sheet tray such that none of the vertical planes through the first sheet tray intersect said fuser.

7. An image formation system according to claim 6, wherein said secondary transfer device is located above said first sheet tray.

8. An image formation system according to claim 6, further comprising a sheet inverter for inverting one of said recording sheets after it has passed through the fuser; and a sheet transport apparatus which transports said one of said recording sheets after it has been inverted back to the secondary transfer device, said sheet transport apparatus having a portion which is (a) above said first portion and (b) within horizontal planes passing through the uppermost and lowermost points of said first sheet tray.

* * * * *